US008567616B2

(12) United States Patent
Mishan et al.

(10) Patent No.: US 8,567,616 B2
(45) Date of Patent: Oct. 29, 2013

(54) DOCK WITH PLURAL CLEANING HEADS

(75) Inventors: Dylan Mishan, New York, NY (US); Stuart Harvey Lee, Forest Hills, NY (US); Jochen Schaepers, New York, NY (US)

(73) Assignee: Dylan Mishan, New York, NY (US)

( * ) Notice: Subject to any disclaimer, the term of this patent is extended or adjusted under 35 U.S.C. 154(b) by 150 days.

(21) Appl. No.: 13/236,849

(22) Filed: Sep. 20, 2011

(65) Prior Publication Data

US 2013/0068647 A1 Mar. 21, 2013

(51) Int. Cl.
*A47F 7/00* (2006.01)

(52) U.S. Cl.
USPC ..... 211/70.6

(58) Field of Classification Search
USPC ..... 211/60.1, 65, 70.6, 66, 68, 373, 37, 73; 220/410, 85 D, 85 R; 206/410, 362, 206/362.3
See application file for complete search history.

(56) References Cited

U.S. PATENT DOCUMENTS

| | | | | | |
|---|---|---|---|---|---|
| 69,026 | A * | 9/1867 | Richmond | 211/68 |
| 130,401 | A * | 8/1872 | Ames | 211/65 |
| 1,208,923 | A * | 12/1916 | Dell | 211/65 |
| 2,584,219 | A * | 2/1952 | Murrell | 312/207 |
| 2,623,642 | A * | 12/1952 | Looney | 211/65 |
| 2,723,026 | A * | 11/1955 | Paige | 206/746 |
| 4,947,998 | A | 8/1990 | Smeller | |
| 5,505,316 | A * | 4/1996 | Lee | 211/70.6 |
| 6,513,889 | B1 * | 2/2003 | Park | 312/206 |
| 6,626,402 | B1 | 9/2003 | Kaminstein | |
| 6,651,829 | B1 * | 11/2003 | Prochaska | 211/70.6 |
| 6,695,153 | B1 * | 2/2004 | Chao | 211/70.6 |
| 6,783,013 | B1 * | 8/2004 | Spann | 211/70.6 |
| 6,848,587 | B1 * | 2/2005 | Chao | 211/70.6 |
| 7,290,311 | B2 * | 11/2007 | Vosbikian et al. | 211/70.6 |
| 7,455,246 | B2 | 11/2008 | Roth et al. | |
| 2008/0016636 | A1 | 1/2008 | Morris et al. | |

* cited by examiner

*Primary Examiner* — Jose V Chen
(74) *Attorney, Agent, or Firm* — Notaro, Michalos & Zaccaria P.C.

(57) ABSTRACT

A dock with plural side-by-side bays that each stores one treatment head. The dock has plural parallel slots that each communicate with a bay and the dock has a first side open to the bays for movement of the heads into and out of the bays. Each head has a connecting post extending through a slot so each post can slide in its slot for removal of each head from a respective bay. A pole has an end connector for detachable connection to a post, one at a time, while the one treatment head is in a bay, and for sliding the head out of the dock for use.

20 Claims, 11 Drawing Sheets

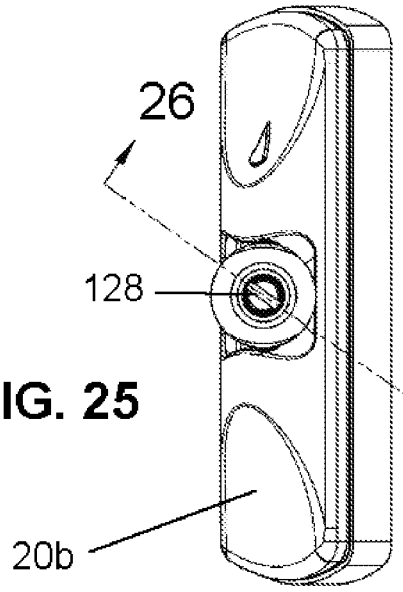
FIG. 25
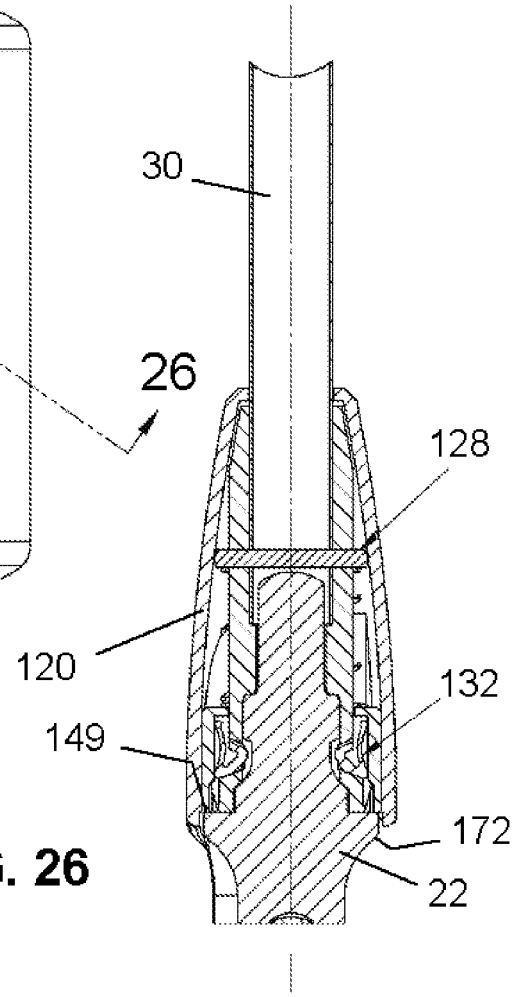
FIG. 26
FIG. 27
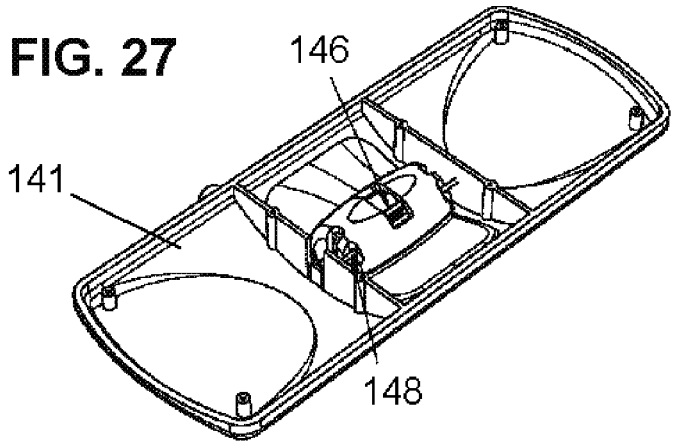

DOCK WITH PLURAL CLEANING HEADS

FIELD AND BACKGROUND OF THE INVENTION

The present invention relates generally to the field of household cleaning implements and in particular to a new and useful arrangement with a floor supported dock for storing and organizing plural household floor cleaning or surface treatment tool heads for use with one pole handle that is also conveniently stored on the dock.

The need for various different types of floor cleaning or treating tools are known such as mops, sponges, brushes and cloth holding heads, and various attempts have been made to make the various cleaning and/or treating tools easily available for use. Floor cleaning can be dry, e.g. using a cloth, broom or brush, moist, e.g. using a damp cloth or sponge, or wet, e.g. using a wet sponge mop, and the term "treatment" is used here to include any and all such cleaning techniques, as well as polishing, waxing or other techniques for treating or cleaning a floor surface or any other surface.

U.S. Pat. No. 4,947,998 to Smeller for an Implement Organized is an example of such an attempt that takes the form of a pall-like reciprocal with a perforated cover that can receive the inverted handle poles of various tools or other implements for easy storage and access. Each tool has its own handle do that there is no savings in space, just a convenient localization of the tools.

U.S. Pat. No. 7,455,246 to Roth et al. for Janitorial Handcart With Chemical Application Apparatus shows a large and more elaborate mechanism for storing multiple cleaning tools for easy access.

Another approach is illustrated by U.S. Pat. No. 6,626,402 to Kaminstein for Cleaning Tool Holder that shows an apparatus for hanging multiple floor treating tools on a wall in a side-by-side manner.

Published Patent Application US2008/0016636 to Morris et al. for Quick-Release Handle And Interchangeable Cleaning System shows a single handle pole with quick-connector device at its end that can be used to connect to multiple different floor treating heads so that one pole can be used for each of the heads.

A need remains for an effective, portable and compact arrangement to store multiple surface treatment heads that are also easily accessible when needed and that can be easily returned when not needed.

SUMMARY OF THE INVENTION

It is an object of the present invention to provided an organizing arrangement for household implements, comprising: a dock for storing plural surface treatment heads, the dock comprising a housing defining plural, horizontally extending, side-by-side and parallel bays each for containing one treatment head, the housing including an upper wall with a plurality of parallel slots therein, each slot communicating with one of the bays, and the housing including a first side that is open to the bays for movement of the treatment heads into and out of each respective bay, the open first side of the housing communicating with open first ends of each slot. The arrangement also has a plurality of treatment heads, each contained fully in one of the bays in a storage position, each head having a connecting post extending upwardly through a respective slot and each slot respectively and slidably receiving each post for removal of each head from each storage position fully in a respective bay, to an intermediate position partly out of the respective bay with the respective post of the head still in the slot but near the open first end of the slot, and then out of the housing through the first open side of the housing for use of the treatment head. A handle pole having a lower end with a connector is detachably connected to the connecting post of one treatment head at a time while the one treatment head is in its storage position, and for sliding the one treatment head to its intermediate position and then out of the housing for use of the one treatment head.

Another object of the invention is to provide the organizing arrangement so that the connector of the handle pole makes a detachable partial connection with each post when the pole is spaced from the respective head of the post by a selected distance when the respective head is in its storage position, that allows the connector to be removed from the post by simply raising the pole off the post, the connector making a detachable full connection with each post when the pole is closer to the head than the selected distance when the respective head is in its intermediate position so that the connector cannot be removed from the post by simply raising the pole off the post, the upper wall of the housing having at least one ramp at least partly extending along each slot from a second end of each slot toward the open first end of each slot, the connector engaging the ramp when making the detachable partial connection with the post in the respective slot for establishing the selected distance between the connector and the head, the ramp decreasing in thickness along the slot until the head with the connector thereon reaches the intermediate position that decreases the spacing between to the connector and the head so that the detachable full connection is made.

Another object of the invention is to provide the organizing arrangement so that the pole with fully connected head can be returned to the dock housing by being inserting by its one end back into the open bay until the thin end of the ramp comes between the pole connector and the head post, and then moving the head deeper into the bay until the head reaches its storage position, whereat the ramp disconnects the pole connector from the post so that the pole can be lifted away from the head.

Another object of the invention is to provide the organizing arrangement wherein each slot has a second closed end that is opposite from the first open end, the post of each head being at the second closed end of each respective slot when each respective head is in its storage position.

According to a still further object of the invention, the organizing arrangement includes a connector recess in the upper wall of the housing for receiving the pole connector for storage of the pole in a storage position, and a support connected to the upper wall near the connector recess for engaging the pole above the connector to keep the pole upright in its storage position, each slot having a second closed end that is opposite from the first open end, the post of each head being at the second closed end of each respective slot when each respective head is in its storage position and the connector recess being on the upper wall of the housing at a location that is spaced from all of the slots.

A squeezer or wringer is also detachably mounted to the dock on its side opposite the open bays for use in squeezing liquid from one or more of the heads.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 25 is a top sectional view of the sponge mop head with pole for showing an internal structure of the pole connector;

FIG. 26 is a sectional view taken along line 26-26 of FIG. 25; and

FIG. 27 is a bottom view of one of the frame of one of the treatment heads for illustrating a pivot feature of the head.

DESCRIPTION OF THE PREFERRED EMBODIMENTS

Figures 1, 2:
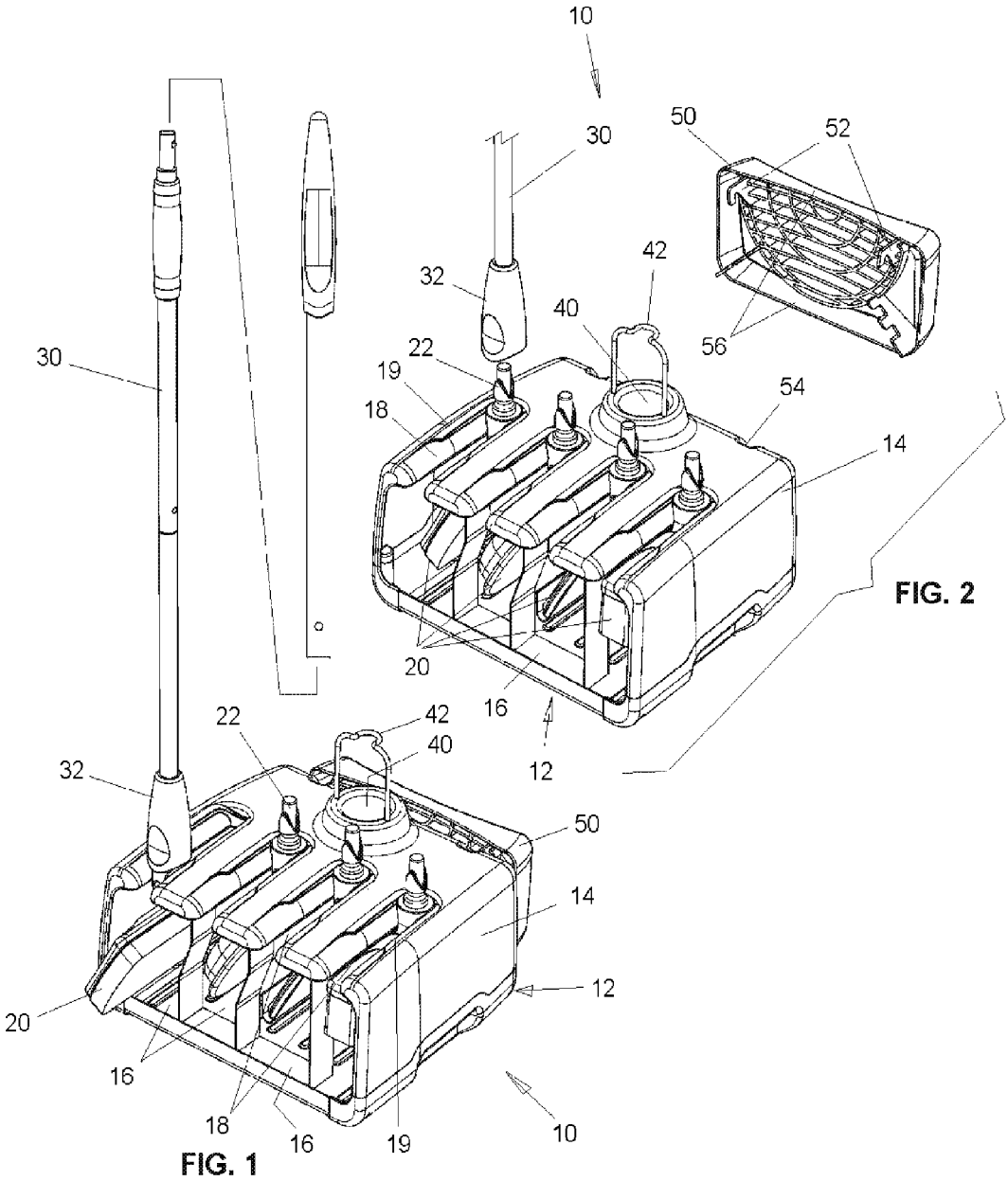
FIG. 1 is a perspective view of an organizing arrangement for household implements such as mops, brushes and other floor cleaning or floor treatment tools or heads.
FIG. 2 is an exploded perspective view of a dock and lower end of a handle pole of the arrangement.
Figure 5:
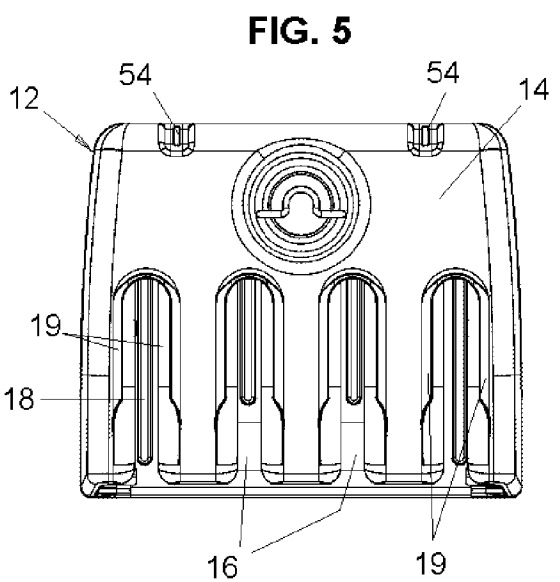
FIG. 5 is a top plan view of the dock without its squeezer member and without the treatment heads.
Figure 6:
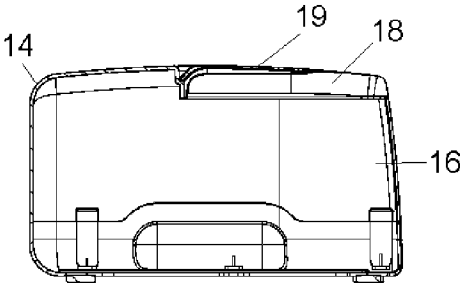
FIG. 6 is a sectional view of the dock housing for better illustrating one of the connector ramps of the arrangement.

Referring now to the drawings, in which like reference numerals are used to refer to the same or similar elements, FIG. 1 shows an organizing arrangement 10 for household implements such as floor or other surface cleaning or treating tools or heads such as cloth holders, sponges, brooms or brushes. The arrangement comprises a dock 12 for storing a plural of such surface treatment heads, the dock in turn comprising a housing 14 defining a plurality of horizontally extending, side-by-side and parallel bays 16 each for containing one treatment head 20. The housing 14 includes an upper wall with a plurality of parallel slots 18 therein, each slot communicating with one of the bays, and the housing also includes a first side visible in FIG. 1, that is open to the bays for movement of the treatment heads 20 into and out of each respective bay 16. The open first side of the housing 14 communicates with open first ends of each slot 18.

Figure 3:
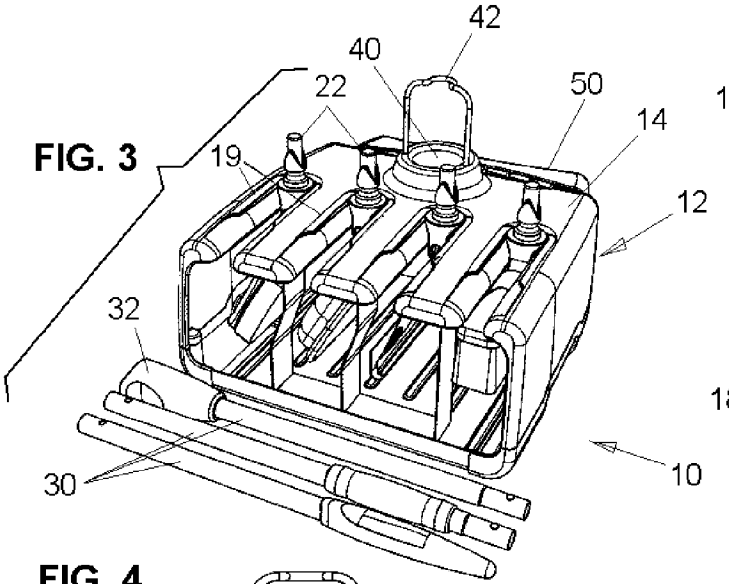
FIG. 3 is a perspective view of the dock and handle pole in sections of the arrangement and showing the treatment heads in their storage positions.
Figure 4:
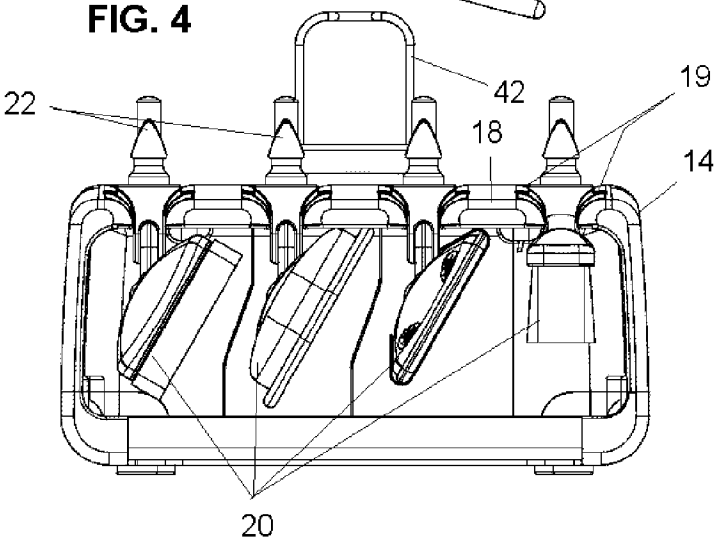
FIG. 4 is a side view of the dock showing the treatment heads in their storage positions.

The plurality of treatment heads 20 are each contained fully in a storage position in one of the bays 16 as illustrated in FIGS. 2 and 3. Each head has a connecting post 22 extending upwardly through a respective slot 18. Each slot 18 respectively, and slidably, receives each post 22 for removal of each head 20 from each storage position that is fully in a respective bay 16, to an intermediate position shown in FIG. 1 at the left where a sponge mop head 20 is being partly moved out of the respective bay 16 with the respective post 22 of the head still in the slot but near the open first end of the slot 18. The pole is then further moved to the left in FIG. 1 to remove the head 20 entirely from the dock housing 14 through the first open side of the housing for use of the treatment head, for example, to mop a floor.

The arrangement also included a handle pole 30 made of three snap connected pole segments as shown in FIGS. 1, 3, 8 and 9. The handle pole 30 has a lower end with a connector 32 for detachable connection to the connecting post 22 of one treatment head 20 at a time while the one treatment head is in its storage position, fully in its bay 16, and for sliding the one treatment head to its intermediate position (FIG. 1, left hand head 20 and left hand bay 16) and then out of the housing for use of the one selected treatment head 20.

The connector 32 of the handle pole 30 makes a detachable partial connection with each post when the pole is spaced from the respective head of the post by a selected distance when the respective head is in its storage position, that allows the connector to be removed from the post by simply raising the pole off the post. The connector 32 makes a detachable full connection with each post 22 when the pole is closer to the head 20 than the selected distance and this occurs when the respective head is in its intermediate position. In this full connection condition, the connector 32 cannot be removed from the post by simply raising the pole off the post but rather the head 20 will also be raises. To achieve these partial and full connection conditions, the upper wall of the housing 14 has at least one ramp 19 at least partly extending along each slot 18 from a second end of each slot toward the open first end of each slot, and preferably a ramp 19 on each side or each slot 18. The connector 32 engages the ramp 19 when making the detachable partial connection with the post in the respective slot for establishing the selected distance between the connector and the head. The ramp 19 decreases in thickness along the slot 18 until the head 20 with the connector 32 thereon, reaches the intermediate position that decreases the spacing between to the connector 32 and the head 20 so that the detachable full connection is made and the head can be removed for the housing and used.

Figures 8, 9:
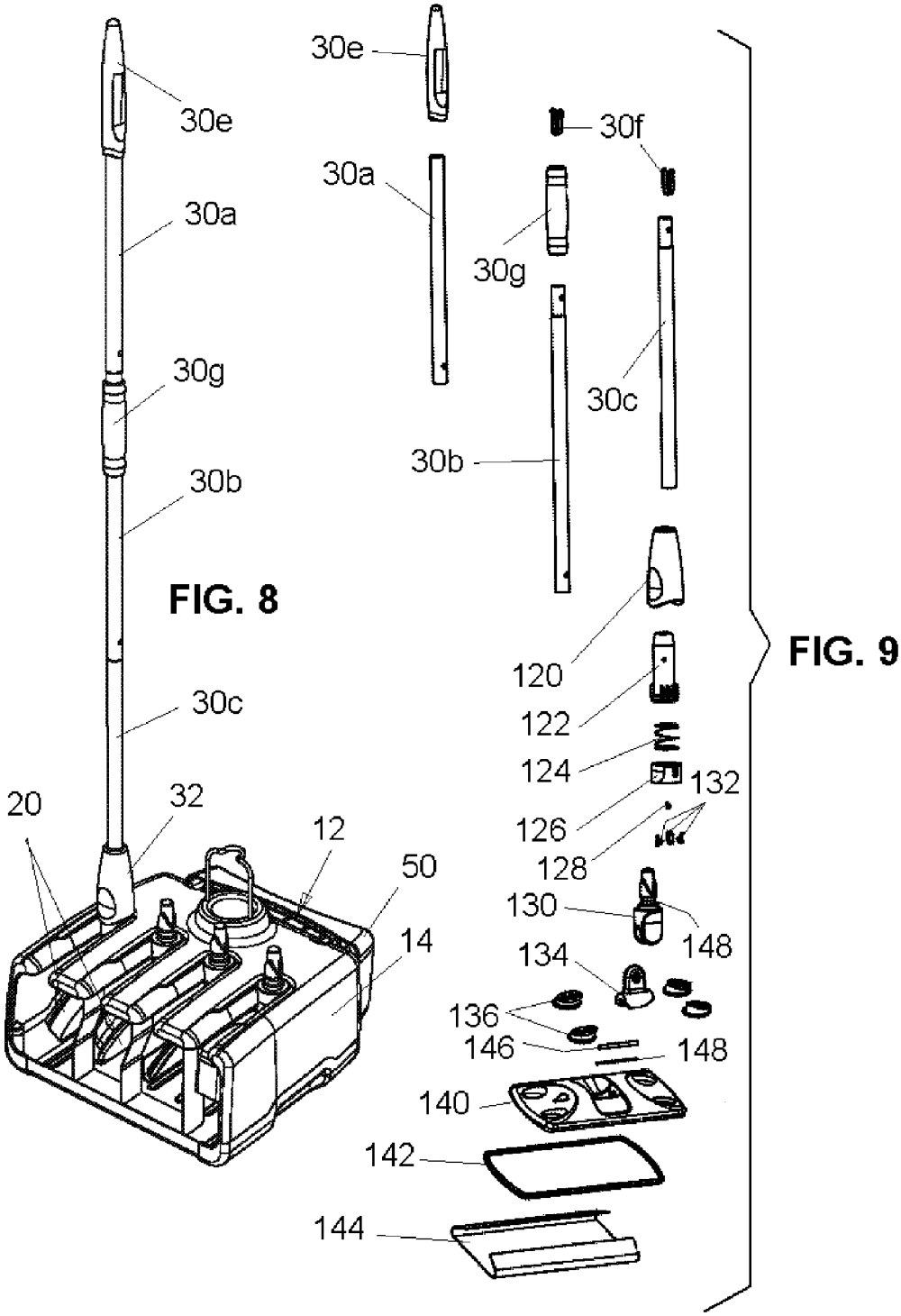
FIG. 8 is a perspective view of the dock housing with the connector of the handle pole in a first, partly engaged position on a post of one of the heads while the head is still in its storage position in the dock housing.
FIG. 9 is an exploded perspective view of the handle pole and one of the treatment heads of the invention.

Each slot 18 has a second closed end that is opposite from the first open end, the post 22 of each head 20 being at the second closed end of each respective slot when each respective head is in its storage position as illustrated in FIG. 8.

Figure 15:
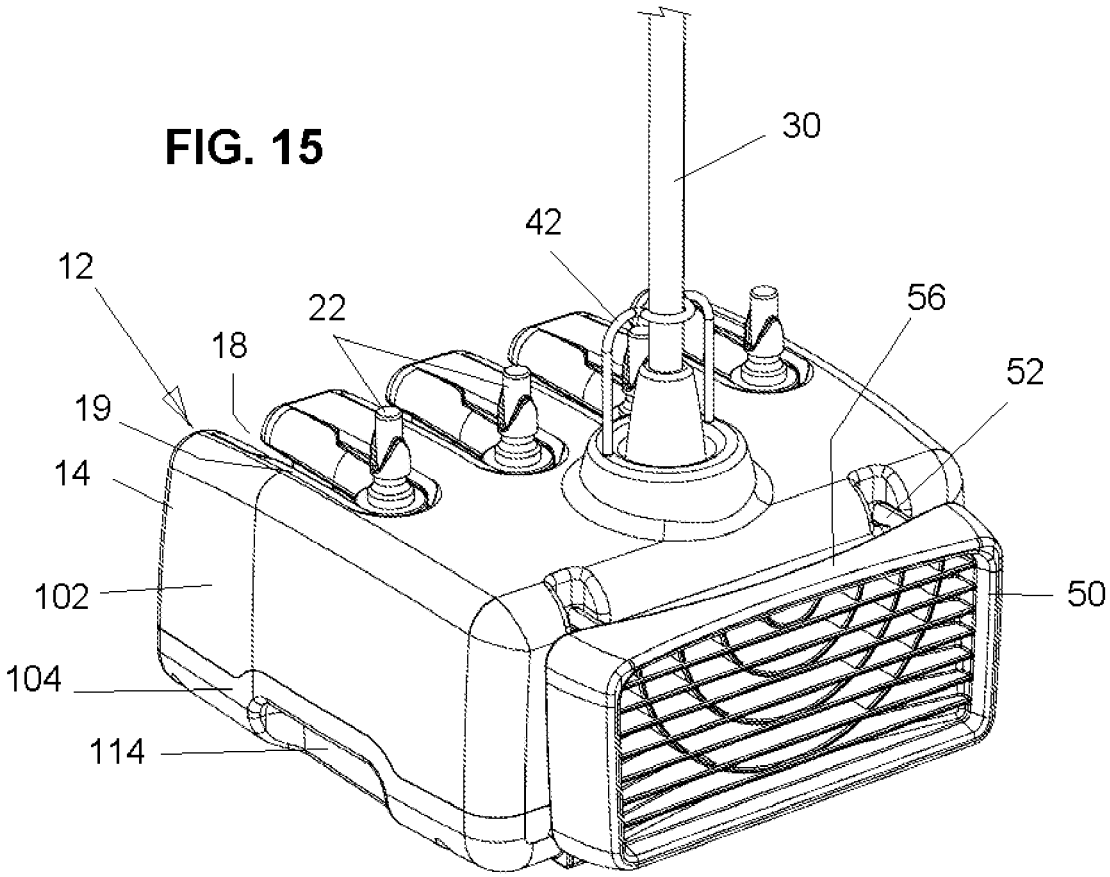
FIG. 15 is a perspective view of the dock housing with the lower end of the handle pole in a holder of the dock and in its storage position, with the squeezer engaged to the dock and also in its storage position.
Figure 16:
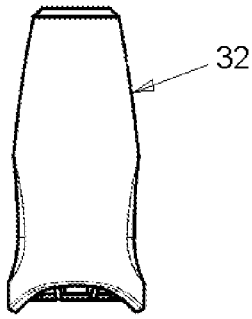
FIG. 16 is a side elevational view of a connector of the handle pole.
Figure 17:
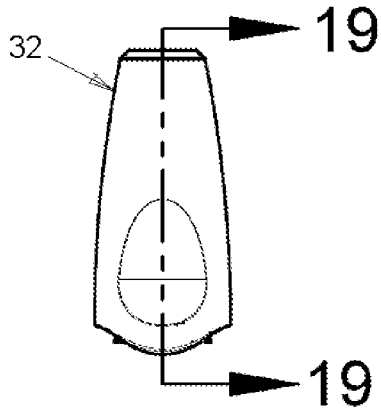
FIG. 17 is a front elevational view of the connector.
Figure 18:
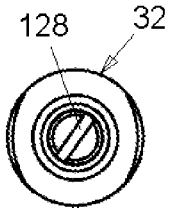
FIG. 18 is a top plan view of the connector with an internal part also visible.
Figure 19:
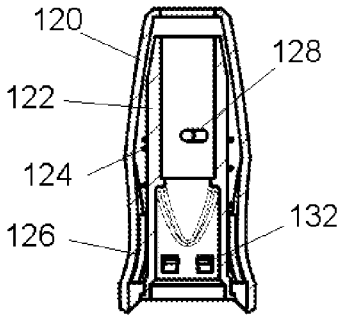
FIG. 19 is a sectional view taken alone line 19-19 of FIG. 17 showing the internal parts of the connector.

The organizing arrangement 10 also includes a connector recess 40 in the upper wall of the housing 14 for receiving the pole connector 32 for storage of the pole in a storage position shown in FIG. 15. A support 42, such as suitably shaped a steel wire, is connected to the upper wall of housing 14 near the connector recess 40 for engaging the pole 30 above the connector 32 to keep the pole upright in its storage position.

The organizing arrangement 10 also includes a wringer 50 best shown in FIGS. 1, 2, 8, 14 and 15, that is detachably connected to the housing 14 on a side of the housing that is opposite from the open ends of the bays 16, the wringer having a perforated grate therethrough for squeezing wet treatment heads, e.g. a sponge mop, thereon to remove liquid from that head 20. The wringer has a flange 56 around the grate and a plurality of, e.g. two, hooks 52. The housing 14 has a hook receiving opening 54 for each hook 52 for mounting the wringer 50 to the housing as shown in FIGS. 8 and 15. The flange 56 has concave long edges for facilitating engagement of the wringer by the hands of a user to squeeze liquid from the wet head 20.

Figure 7:
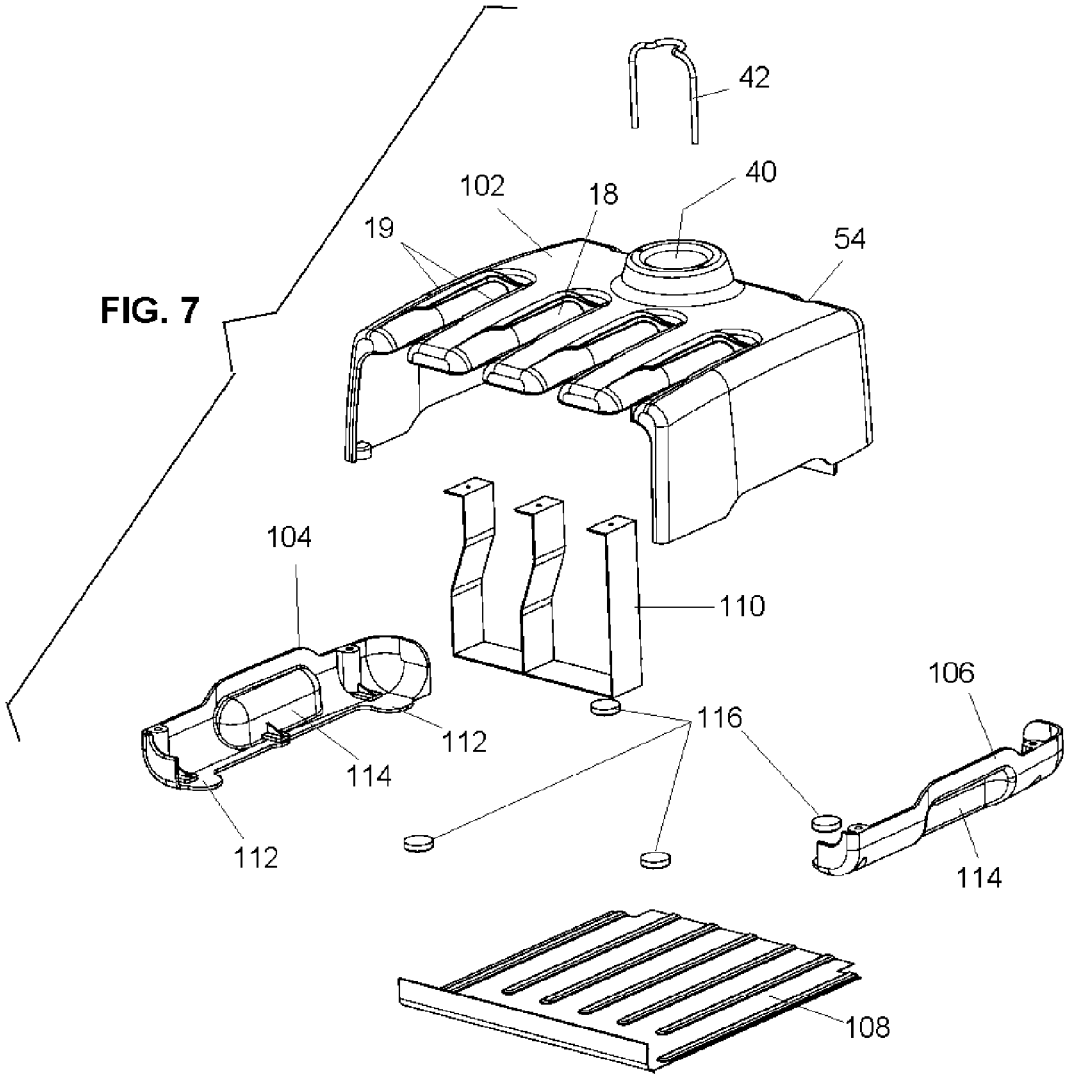
FIG. 7 is an exploded perspective view of the dock housing in its component parts.

With reference to FIGS. 7 and 15, the dock housing 14 comprises a top member 102 defining the upper wall with the slots 18, the first open side to the bays 16, an oppose closed wall, and left and right side walls. The housing is further made up of left 106, and right 104 side members connected to lower edges of the respective left and right side walls of member 102. The members 102, 104 and 106 are preferably make of plastic, e.g. ABS (acrylonitrile butadiene styrene) plastic, and the lower left and right members 106 and 104 are connected to the top member 102 by standard means like screws. The housing 14 also has a lower drip tray 108, e.g. of aluminum, engaged between the side members 104, 106 and extending below the plurality of bays 16 and treatment heads 20 in the dock to catch liquid that may drip from one or more of the heads 20. A support column member 110 made, for example of steel, is suspended, e.g. using screws, from an inner surface of the upper wall of top member 102, and has plural, e.g. three, generally vertical arms for dividing the interior of the dock housing 14 into the plurality, e.g. four, of bays 16. Fewer or more bays 16 may be provided.

Each side member 104 and 106 also has a pair of inwardly extending tabs 112 on which the opposite sides of the tray 108 are supported. The side members 104 and 106 also have formed hand recesses 114 that can be engaged by the hands of a used to lift and move the dock 12. High friction, e.g. rubber feet 116 are glued to the bottom of side members 104 and 106 to keep the dock in place as the heads 20 are slid out of and back into the bays 16. Alternatively long rubber pads can be provided alone the lower surface of each side member 104, 106, to resist sliding of the dock 12.

As already disclosed, the connector recess 40 is formed in the upper wall of the top member 102 of the housing 14 for receiving the pole connector for storage of the pole in the storage position of FIG. 15, and the support 42, e.g. made of steel wire, is connected, e.g. but being press fit and glued or heat sealed into a pair of holes in the upper wall near the connector recess 40, for engaging the pole 30 above the connector 32 to keep the pole upright in its storage position as also shown in FIG. 15.

Referring now to FIGS. 8 and 9, the handle pole 30 is advantageously made of three sections, for example, aluminum tubes 30*a*, 30*b* and 30*c* that are detachably connected to each other by known spring-plus-ball combinations 30*f* that are mounted in small diameter ends of sections 30*b* and 30*c*. Each ball is seated in the hole of a larger diameter end of the next section to form the single long handle pole shown in FIG. 8. The use of a sectioned pole 30 permits easier packaging for sale and shipping of the arrangement as shown in FIG. 3. A top handle 30*e* of plastic, e.g. PP (polypropylene), is press fit, glued or otherwise fixed to the top of top section 30*a* and an intermediate handle 30*g* of foam rubber or other soft synthetic material is glued onto intermediate section 30*b*, near its top end, for easier handling and added leverage on the handle pole 30 when needed. The connector 32 is fixed to the lower end of lower section 30*c* in a manner to be further explained with reference to FIGS. 9 and 16 to 19.

In FIG. 9, the connector 32 is shown exploded into its several parts that permit the establishment of the detachable partial connection where the connector can still be lifted away from the post of the treatment head, and the detachable full connection where the connector is fixed to the post well enough for the head to be manipulated by the pole for use to clean a floor or other surface. Although a preferred embodiment of the connector is disclosed, other known connectors may be used that are capable of making the partial and full connections between the pole connector and the post.

Figure 10:
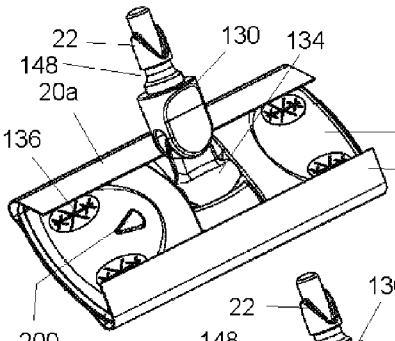
FIG. 10 is a perspective view of one of the treatment heads in the form of a dry or damp cloth holder.
Figure 11:
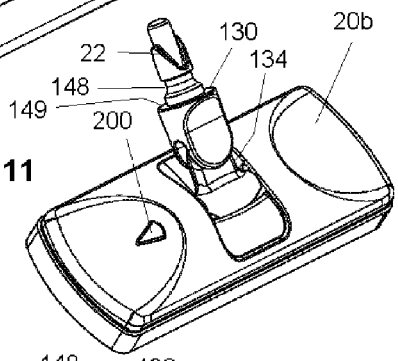
FIG. 11 is a perspective view of another one of the treatment heads in the form of a sponge or sponge mop.
Figure 14:
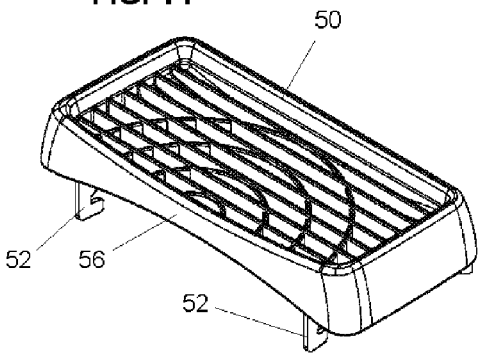
FIG. 14 is a perspective view of a wringing or squeezing tool that is removably mounted to the dock housing for use in wringing out liquid for the sponge of the head of FIG. 11, or from another one of the treatment heads that need squeezing to remover liquid, such as excess water.
Figure 12:
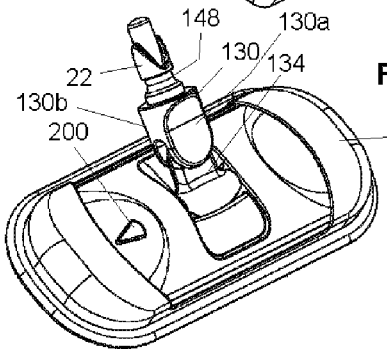
FIG. 12 is a perspective view of another treatment head that carries a polishing or waxing cloth wrapped thereon.
Figure 13:
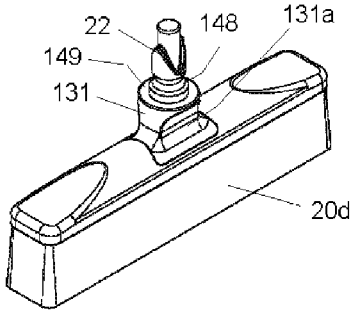
FIG. 13 is a perspective view of another treatment head in the form of a brush or broom.

Turning to FIGS. 10 to 13, some of the various types of treatment heads that can be used in the arrangement of the invention are illustrated. FIG. 10 shows a dry or damp cloth wipe head 20*a* that has four rubber cloth catches 136 for holding a cleaning cloth 144 to a frame 140, e.g. of PP, for head 20*a*, that are of known design. A rubber bumper 142 extends around the frame 140 of head 20*a* to protect walls and furniture. FIG. 11 shows a head 20*b* in the form of a sponge mop. FIG. 12 illustrates a microfiber cloth covered head 20*c*. In each of heads 20*a*, 20*b* and 20*c*, the post 22 is part of a pivot member 130 that has flattened front and rear surfaces 130*a*, 130*b* that are shaped to fit closely in one of the housing slots 18 while keeping the head properly aligned it its respective bay 16. As also illustrated in FIG. 9, each pivot member 130 has a lower pair of ears that are pivotally connected to a cardan joint 134 which in turn is pivotally connected by a pin 146 and rod spring 148 to the head 20*a*, 20*b* or 20*c* so that the head can pivot about two orthogonal axes for cleaning. An arrow marker 200 is also provided on the upper surface of these heads which indicated the correct entry direction of the head into a bay 16 of housing 14. FIG. 13 shows a brush or broom head 20*d* where the post 22 is fixed to a member 131 that also has flattened front and rear surfaces 131*a* to fit well into a slot 18, but no pivotal mounting since for the brush or broom 20*d*, a fixed connection between the handle pole 30 and the head is required by proper control. FIG. 14 is another view of the wringer 50 with its parts.

As shown in FIGS. 9 and 16 to 19, and as will be explained even more fully in connection with subsequent figures, each of the posts 22 has a cam surface with two peaks and two valleys between the peaks that match corresponding valleys and peaks in an internal connector body 122 of connector 32, to insure that the connector 32 at the bottom of the handle pole 30 will engage the head in only two possible positions. This is needed to further insure that a proper latching action occurs between the catches 132 and the post 22 to establish the full connection between the pole 30 and post 22 of each head 20.

As shown in FIGS. 9 and 16 to 19, the connector 32 includes an outer sleeve 120 of plastic like PP, the internal connector body 122 also of plastic like PP, a spring 124 of spring steel, an inner sleeve 126 e.g. of PP, a connector pin 128 e.g. of stainless steel, and catches 132, e.g. of nylon. Connector pin 128 extends in two short circumferential slots in internal body 122 to allow a small amount of relative rotation between the body 122 and the outer sleeve 120 so that the inner cam surfaced in body 122 that are visible in FIG. 19, can easily align along the peaks and valleys of the post 22 to establish the partial connection between the connector 32 and the post 22. Spring 124 biases the inner sleeve 126 downwardly onto a lower large diameter end of body 122 which also keeps inner sleeve 126 from being pushed out of the lower end of outer sleeve 120.

The catches 132 are mounted in openings in body 122 and sleeve 126 so that under the influence of spring 120, they will pivot into an annular recess 168 in a post 22 to secure the connector 32 to the post in the full connection mode as soon as the connector is permitted to get closer to the base of the post 22, as the head 20 is being slid along the slot 18 and the ramp 19 thickness below a lower edge of the outer sleeve 120, has decreases sufficiently to allow connector 32, or more accurately the inner sleeve 126, to more closely approach the head 20. Before this closer approach the connector 32 is only partially connected to the post 22 and can be lifted off the post, e.g. so the user can selected a different head if desired.

After the full connection has been established and the head has been withdrawn from the dock 12 and used, to disengage the handle pole 30 from the head 20, the head is inserted in the direction of arrow mark 200 back into an empty one of the bays 16 and as the flattened sides 130*a* and 130*b* or 131 a sliding along the slot 18 to keep the head aligned properly, the ramp 19 starts to encroach between the lower edge of the inner and outer sleeves 126 and 120 and an upper large diameter step 149 at the base of the post 22. This lifts the inner sleeve 126 against the bias of spring 124, causing the catches 132 to move out of the annular recess 168 and release the connected to its partial connection mode with the connector 32 so that one the head 20 is back in its storage position, the connector 32 with pole 30 can be lifted away for the post 22 for further use or storage.

Figures 20, 21:
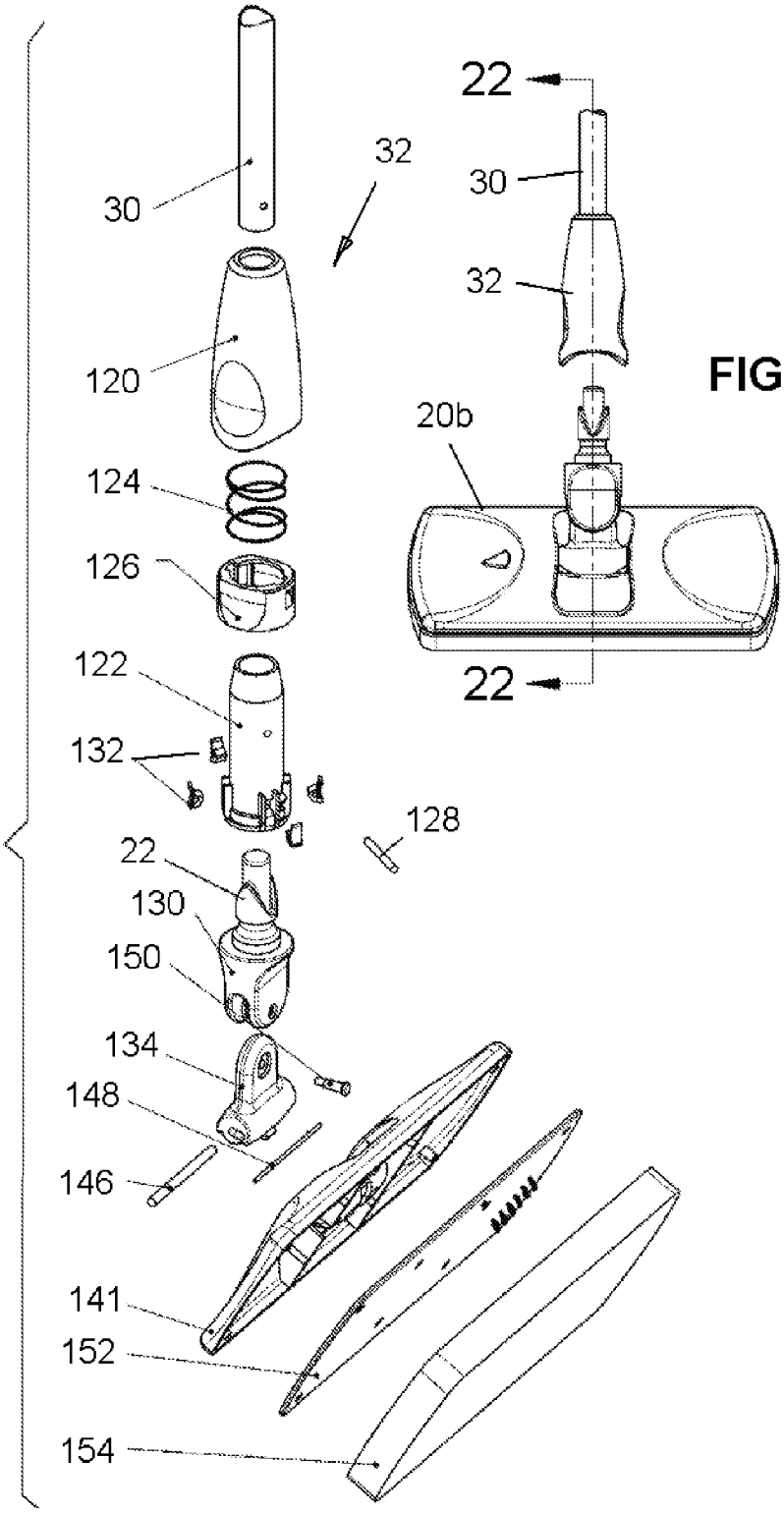
FIG. 20 is a front, partial, exploded view of a sponge mop head and the lower end of a handle pole and connector of the invention.
FIG. 21 is an enlarge exploded view of the pole connector and sponge mop head that is on an enlarged scale to better show details of the invention.

FIG. 20 shows the connector 32 made up of the outer sleeve 120, internal connector body 122, spring 124, inner sleeve 126, connector pin 128 and four catches 132. Connector pin 128 also extends out of body 122 sufficiently to act as the upper stop for spring 124 as shown in FIGS. 25 and 26, spring 124 biasing the inner sleeve 126 downwardly. As shown in FIGS. 20 and 21, cardan pin 150 pivotally connects cardan 134 to pivot member 130 and the sponge mop head 20*b* includes a plastic frame 141, a mop head cling panel 152 and the foam sponge or sponge mop 154 proper.

Figure 22:
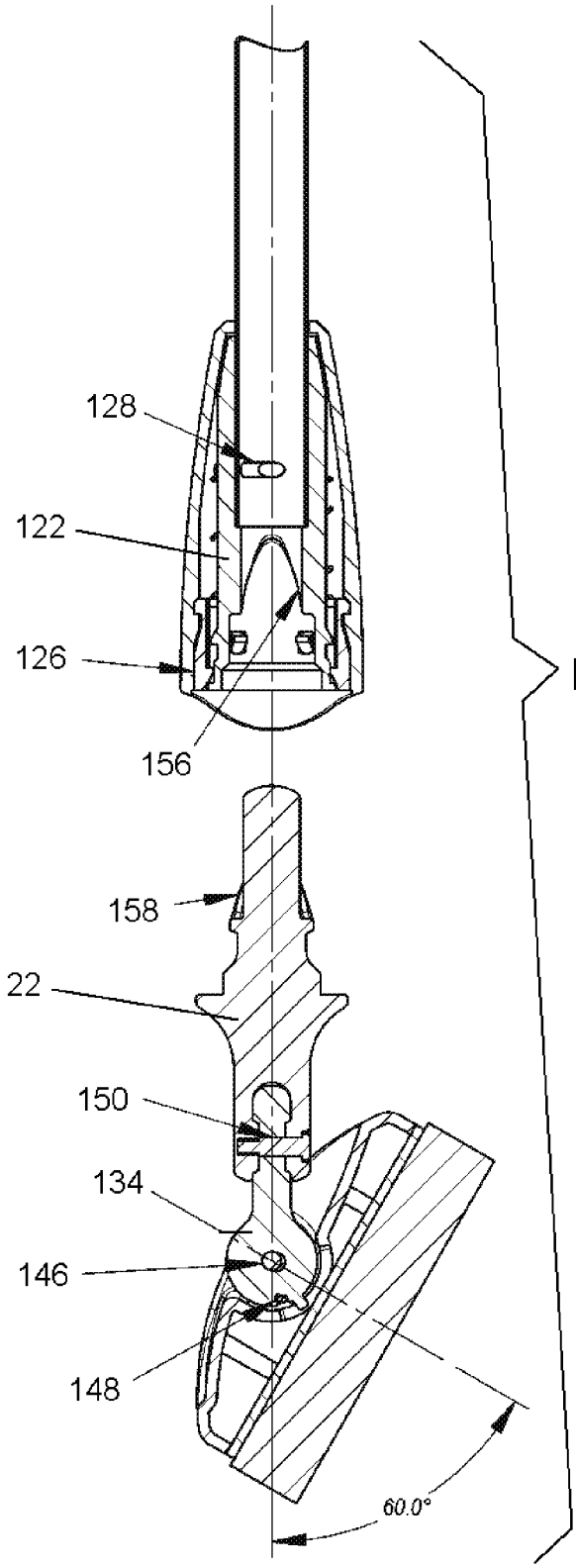
FIG. 22 is a sectional view taken along line 22-22 of FIG. 20.

FIG. 22 shows the post 22 to have its cam surface 158 with two peaks and two valleys between the peaks that match corresponding valleys and peaks of the cam surface 156 in the internal connector body 122 of connector 32 to insure that the connector 32 at the bottom of the handle pole 30 will engage the head in only two possible positions. FIG. 22 also shows how rod spring 148 holds the head at an angle, e.g. of 60 degrees, on pin 146 in cardan 134 as also shown in FIG. 27.

Figure 24:
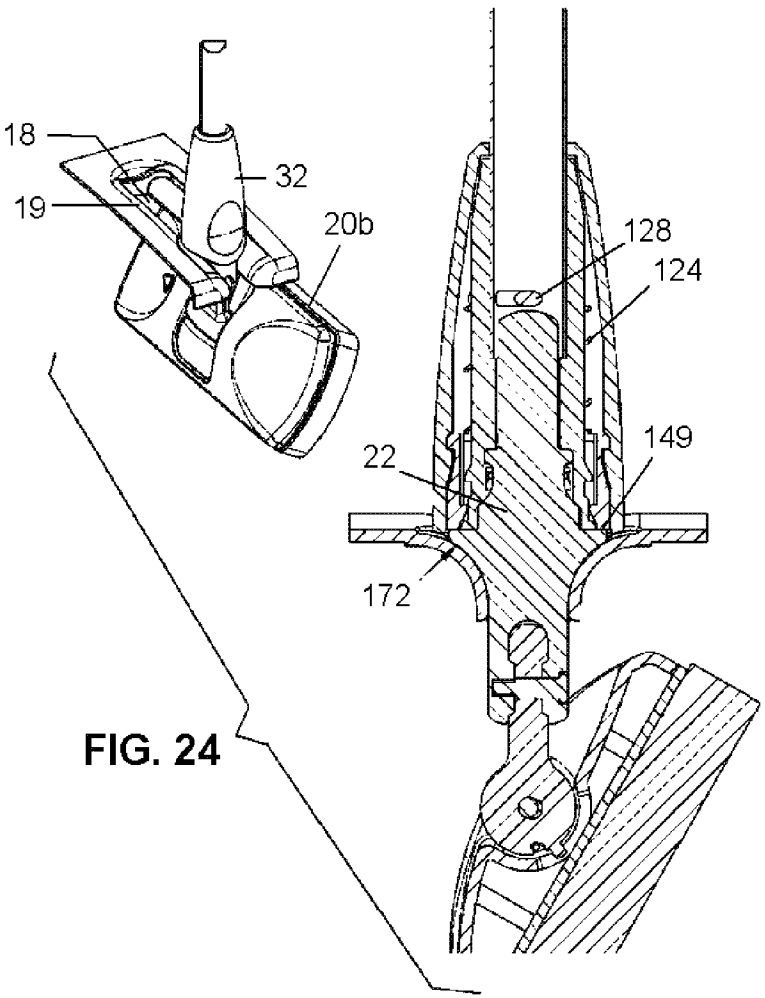
FIG. 24 is a composite view similar to FIG. 23, but with the sponge mop head of the invention in an intermediate position for establishing a full connection.
Figure 23:
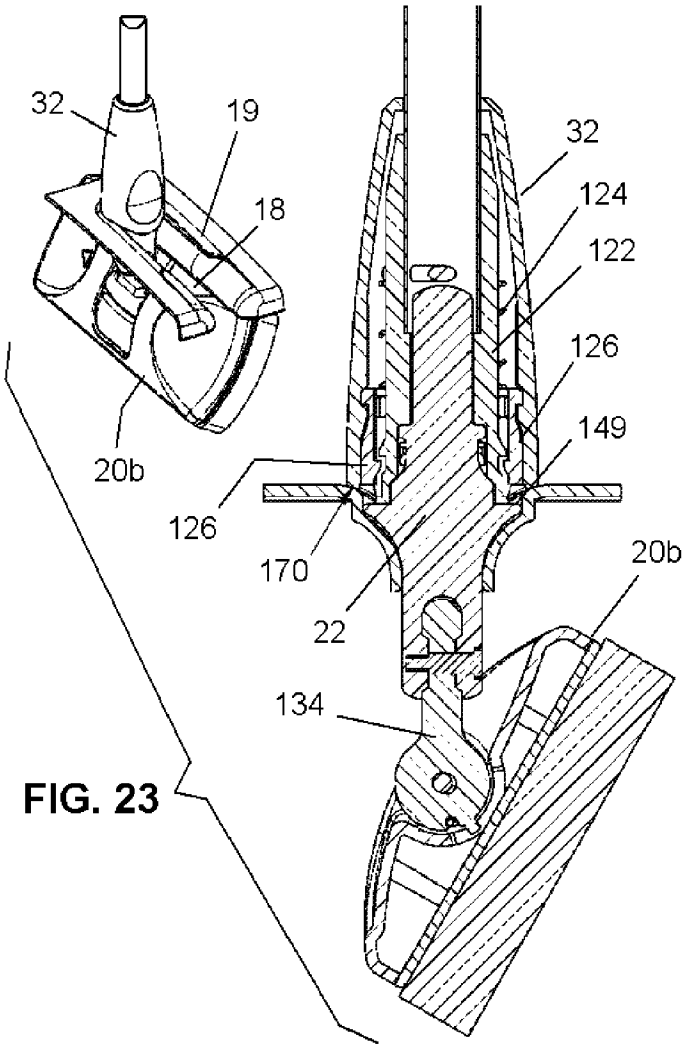
FIG. 23 is a composite view showing the storage position for a sponge mop head in a slot of the invention plus a sectional view of the connector and other key parts of the invention for establishing a partial connection.

FIG. 23 shows at the left the relative position of connector 32 in slot 18 and on the high or thick side of ramp 19 for establishing the partial connection for connector 32 to post 22 as shown n the right of FIG. 23, where the inner sleeve 126 is being held up by ramp 19 and against the bias of spring 124 from the step 149 in post 22. In this storage position for head 20*b*, the lower edge 169 of outer sleeve 120 slides on the housing top wall, next to ramp 19. As the head is moved to the intermediate position shown at the left in FIG. 24, the inner sleeve 126 is lowered on ramp 19 and by the bias of spring 124 to lock the connector 32 to the post via catches 132 as also shown in the full connection condition in FIG. 26. At 172 in FIG. 24 at the right the diameter of post 22 at step 149 is smaller that the inside diameter of outer sleeve 120 to that the ramp can interact with the inner sleeve 126 without the outer sleeve 120 interfering.

While a specific embodiment of the invention has been shown and described in detail to illustrate the application of the principles of the invention, it will be understood that the invention may be embodied otherwise without departing from such principles.

What is claimed is:

1. An organizing arrangement (10) for household implements, the arrangement comprising:

a dock (12) for storing a plural of surface treatment heads, the dock comprising a housing (14) defining a plurality of horizontally extending, side-by-side and parallel bays (16) each for containing one treatment head (20), the housing (14) including an upper wall with a plurality of parallel slots (18) therein, each slot communicating with one of the bays, and the housing including a first side that is open to the bays for movement of the treatment heads into and out of each respective bay, the open first side of the housing (14) being contiguous with the open first ends of each slot;

a plurality of treatment heads (20), each head being contained fully in one of the bays (16) to define a storage position for each head, each head having a connecting post (22) extending upwardly through a respective slot (18), each slot respectively and slidably receiving each post for removal of each head from each storage position fully in a respective bay, to an intermediate position partly out of the respective bay with the respective post of the head still in the slot but near the open first end of the slot, and then out of the housing through the first open side of the housing for use of the treatment head; and a handle pole (30) having a lower end with a connector (32) for detachable connection to the connecting post (22) of a selected one treatment head (20) while the selected one treatment head is in its storage position, and for sliding the selected one treatment head to its intermediate position and then out of the housing for use of the selected one treatment head (20).

2. The organizing arrangement of claim 1, wherein the connector (32) of the handle pole (30) makes a detachable partial connection with each post when the pole is spaced from the respective head of the post by a selected distance when the respective head is in its storage position, that allows the pole to be used to slide the respective head but that also allows the connector to be removed from the post by raising the pole off the post, the connector (32) making a detachable full connection with each post when the pole is closer to the head (20) than the selected distance when the respective head is in its intermediate position so that the connector cannot be removed from the post by raising the pole off the post, the upper wall of the housing (14) having at least one ramp (19) at least partly extending along each slot (18) from a second end of each slot toward the open first end of each slot, the connector (32) engaging the ramp (19) when making the detachable partial connection with the post in the respective slot for establishing the selected distance between the connector and the head, the ramp (19) decreasing in thickness along the slot until the head (20) with the connector (32)

thereon reaches the intermediate position that decreases the spacing between to the connector and the head so that the detachable full connection is made.

3. The organizing arrangement of claim 1, wherein each slot (18) has a second closed end that is opposite from the first open end, the post (22) of each head (20) being at the second closed end of each respective slot when each respective head is in its storage position.

4. The organizing arrangement of claim 1, wherein each slot (18) has a second closed end that is opposite from the first open end, the post (22) of each head (20) being at the second closed end of each respective slot when each respective head is in its storage position, the connector (32) of the handle pole (30) making a detachable partial connection with each post when the pole is spaced from the respective head of the post by a selected distance when the respective head is in its storage position and the post is at the second closed end of the slot, that allows the pole to be used to slide the respective head but that also allows the connector to be removed from the post by raising the pole off the post, the connector (32) making a detachable full connection with the post when the pole is closer to the head than the selected distance when the respective head is in its intermediate position so that the connector cannot be removed from the post by raising the pole, the upper wall of the housing (14) having a pair of ramps (19) at least partly extending along each side or each slot (18) from the second closed end of each slot toward the open first end of each slot, the connector (32) engaging the ramps (19) when making the detachable partial connection with the post in the respective slot for setting the selected distance between the connector and the head, the ramps (19) decreasing in thickness along the slot until the head (20) with the connector (32) reaches the intermediate position that decreases the spacing between to the connector and the head so that the detachable full connection is made.

5. The organizing arrangement of claim 1, including a connector recess (40) in the upper wall of the housing (14) for receiving the pole connector (32) for storage of the pole in a storage position, and a support (42) connected to the upper wall near the connector recess (40) for engaging the pole (30) above the connector (32) to keep the pole upright in its storage position.

6. The organizing arrangement of claim 1, including a connector recess (40) in the upper wall of the housing (14) for receiving the pole connector (32) for storage of the pole in a storage position, and a support (42) connected to the upper wall near the connector recess (40) for engaging the pole (30) above the connector (32) to keep the pole upright in its storage position, each slot (18) having a second closed end that is opposite from the first open end, the post (22) of each head (20) being at the second closed end of each respective slot when each respective head is in its storage position and the connector recess (40) being on the upper wall of the housing (14) at a location that is spaced from all of the slots (18).

7. The organizing arrangement of claim 1, including a wringer (50) detachably connected to the housing (14) on a side of the housing that is opposite from the open ends of the bays (16), the wringer having a perforated grate therethrough for squeezing a selected wet treatment head thereon to remove liquid for the selected head (20), the wringer having a flange around the grate and a plurality of hooks (52), the housing (14) having a hook receiving opening (54) for each hook for mounting the wringer to the housing, the flange (56) having concave edges for facilitating engagement of the wringer on the hands of an user to squeeze liquid from the selected head.

8. The organizing arrangement of claim 1, wherein the dock housing (14) comprises a top member (102) defining the upper wall with the slots (18), the first open side to the bays (16), an oppose closed wall, and left and right side walls, left and right side members (104, 106) connected to lower edges of the respective left and right side walls, a lower drip tray (108) engaged between the side members (104, 106) extending below the plurality of bays (16) and treatment heads (20) in the dock, and a support column member (110) suspended from an inner surface of the upper wall for dividing the dock housing into the plurality of bays (16).

9. An organizing arrangement (10) for household implements, the arrangement comprising: a dock (14) with plural side-by-side bays (16) each storing one treatment head (20); the dock having a plural parallel slots (18) that are each contiguous with a bay and the dock has a first side open to the bays for movement of the heads (20) into and out of the bays (16); each head (20) has a connecting post (22) extending through a slot (18) so each post can slide in its slot for removal of each head (20) from a respective bay (16), and a pole (30) having an end connector (32) for detachable connection to a selected post (22), while the treatment head of the selected post is in a bay, and for sliding the head of the selected post out of the dock for use.

10. The organizing arrangement of claim 9, wherein the connector (32) makes a detachable partial connection with each post when the pole is spaced from the respective head of the post by a selected distance when the respective head is in a bay, that allows the pole to be used to slide the respective head but that also allows the connector to be removed from the post by raising the pole off the post, the connector (32) making a detachable full connection with each post (22) when the pole is closer to the head (20) so that the connector cannot be removed from the post by raising the pole off the post.

11. The organizing arrangement of claim 9, wherein each slot (18) has a closed end that is opposite the open end, the post (22) of each head (20) being at the second closed end of each respective slot when each respective head is fully in its bay.

12. The organizing arrangement of claim 9, including a connector recess (40) in an upper wall of the dock (14) for receiving the pole connector (32) for storage of the pole in a storage position, and a support (42) connected to the upper wall near the connector recess (40) for engaging the pole (30) above the connector (32) to keep the pole upright in its storage position.

13. The organizing arrangement of claim 9, including a wringer (50) detachably connected to the housing (14) on a side of the housing that is opposite from open ends of the bays (16), the wringer having a perforated grate therethrough for squeezing a selected wet treatment head thereon to remove liquid for the selected head (20).

14. The organizing arrangement of claim 9, wherein the dock (14) comprises a top member (102) defining the upper wall with the slots (18), the first open side to the bays (16), an oppose closed wall, and left and right side walls, left and right side members (104, 106) connected to lower edges of the respective left and right side walls, a lower drip tray (108) engaged between the side members (104, 106) extending below the plurality of bays (16) and treatment heads (20) in the dock, and a support column member (110) suspended from an inner surface of the upper wall for dividing the dock housing into the plurality of bays (16).

15. An organizing arrangement (10) for household implements, the arrangement comprising:

a dock (12) for storing a plural of surface treatment heads, the dock comprising a housing (14) defining a plurality of horizontally extending, side-by-side and parallel bays (16) each for containing one treatment head (20), the housing (14) including an upper wall with a plurality of parallel slots (18) therein, each slot communicating with one of the bays, and the housing including a first side that is open to the bays for movement of the treatment heads into and out of each respective bay, the open first side of the housing (14) being contiguous with the open first ends of each slot;

a plurality of treatment heads (20), each head being contained fully in one of the bays (16) to define a storage position for each head, each head having a connecting post (22) extending upwardly through a respective slot (18), each slot respectively and slidably receiving each post for removal of each head from each storage position fully in a respective bay, to an intermediate position partly out of the respective bay with the respective post of the head still in the slot but near the open first end of the slot, and then out of the housing through the first open side of the housing for use of the treatment head; and a handle pole (30) having a lower end with a connector (32) for detachable connection to the connecting post (22) of a selected one treatment head (20) while the one treatment head is in its storage position, and for sliding the selected one treatment head to its intermediate position and then out of the housing for use of the selected one treatment head (20);

the connector (32) of the handle pole (30) making a detachable partial connection with each post when the pole is spaced from the respective head of the post by a selected distance when the respective head is in its storage position, that allows the pole to be used to slide the respective head but that also allows the connector to be removed from the post by raising the pole off the post, the connector (32) making a detachable full connection with each post when the pole is closer to the head (20) than the selected distance when the respective head is in its intermediate position so that the connector cannot be removed from the post by raising the pole off the post.

16. The organizing arrangement of claim 15, wherein each slot (18) has a second closed end that is opposite from the first open end, the post (22) of each head (20) being at the second closed end of each respective slot when each respective head is in its storage position.

17. The organizing arrangement of claim 15, including a connector recess (40) in the upper wall of the housing (14) for receiving the pole connector (32) for storage of the pole in a storage position, and a support (42) connected to the upper wall near the connector recess (40) for engaging the pole (30) above the connector (32) to keep the pole upright in its storage position.

18. The organizing arrangement of claim 15, including a connector recess (40) in the upper wall of the housing (14) for receiving the pole connector (32) for storage of the pole in a storage position, and a support (42) connected to the upper wall near the connector recess (40) for engaging the pole (30) above the connector (32) to keep the pole upright in its storage position, each slot (18) having a second closed end that is opposite from the first open end, the post (22) of each head (20) being at the second closed end of each respective slot when each respective head is in its storage position and the connector recess (40) being on the upper wall of the housing (14) at a location that is spaced from all of the slots (18).

19. The organizing arrangement of claim 15, including a wringer (50) detachably connected to the housing (14) on a side of the housing that is opposite from the open ends of the bays (16), the wringer having a perforated grate therethrough for squeezing a selected wet treatment head thereon to remove liquid for the selected head (20), the wringer having a flange around the grate and a plurality of hooks (52), the housing (14) having a hook receiving opening (54) for each hook for mounting the wringer to the housing, the flange (56) having concave edges for facilitating engagement of the wringer on the hands of an user to squeeze liquid from the selected head.

20. The organizing arrangement of claim 15, wherein the dock housing (14) comprises a top member (102) defining the upper wall with the slots (18), the first open side to the bays (16), an oppose closed wall, and left and right side walls, left and right side members (104, 106) connected to lower edges of the respective left and right side walls, a lower drip tray (108) engaged between the side members (104, 106) extending below the plurality of bays (16) and treatment heads (20) in the dock, and a support column member (110) suspended from an inner surface of the upper wall for dividing the dock housing into the plurality of bays (16).

* * * * *